US009409372B2

(12) United States Patent
Hada et al.

(10) Patent No.: US 9,409,372 B2
(45) Date of Patent: Aug. 9, 2016

(54) METHOD FOR PERFORATING TISSUE SHEETS

(75) Inventors: Frank Stephen Hada, Appleton, WI (US); James Leo Baggot, Menasha, WI (US); Robert Eugene Krautkramer, Combined Locks, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 1317 days.

(21) Appl. No.: 12/345,174

(22) Filed: Dec. 29, 2008

(65) Prior Publication Data

US 2010/0167896 A1 Jul. 1, 2010

(51) Int. Cl.

| | |
|---|---|
| ***B31D 1/04*** | (2006.01) |
| ***B26D 7/20*** | (2006.01) |
| ***B26F 1/20*** | (2006.01) |

(52) U.S. Cl.

CPC .. *B31D 1/04* (2013.01); *B26D 7/20* (2013.01); *B26F 1/20* (2013.01); *B26D 2007/202* (2013.01); *B31F 2201/0797* (2013.01)

(58) Field of Classification Search

USPC ..... 493/365, 363, 364, 366, 340, 370, 371

See application file for complete search history.

(56) References Cited

U.S. PATENT DOCUMENTS

| | | | | | |
|---|---|---|---|---|---|
| 3,496,260 | A | * | 2/1970 | Guenther et al. | 264/156 |
| 3,550,826 | A | * | 12/1970 | Salmela | 225/3 |
| 3,683,559 | A | * | 8/1972 | Kalwaites | 451/188 |
| 3,719,736 | A | * | 3/1973 | Woodruff | 264/156 |
| 3,845,682 | A | * | 11/1974 | Willhite et al. | 83/431 |
| 3,855,046 | A | * | 12/1974 | Hansen et al. | 428/198 |
| 3,859,879 | A | * | 1/1975 | Spengler | 83/155 |
| 4,133,088 | A | * | 1/1979 | Hikobe et al. | 28/279 |
| 4,319,868 | A | * | 3/1982 | Riemersma et al. | 425/290 |
| 4,486,377 | A | * | 12/1984 | Lucchesi et al. | 264/510 |
| 4,487,377 | A | * | 12/1984 | Perini | 242/521 |
| 4,640,165 | A | * | 2/1987 | McMahon et al. | 83/346 |
| 4,687,153 | A | * | 8/1987 | McNeil | 242/521 |
| 4,691,908 | A | * | 9/1987 | Bradley | 270/21.1 |
| 5,137,225 | A | | 8/1992 | Biagiotti | |
| 5,151,077 | A | * | 9/1992 | Cole et al. | 493/353 |
| 5,230,268 | A | * | 7/1993 | Richter | 83/303 |
| 5,248,106 | A | | 9/1993 | Biagiotti | |
| 5,538,199 | A | | 7/1996 | Biagiotti | |
| 5,542,622 | A | | 8/1996 | Biagiotti | |
| 5,836,228 | A | * | 11/1998 | Guthrie et al. | 83/342 |
| 5,839,688 | A | * | 11/1998 | Hertel et al. | 242/523.1 |
| 5,919,177 | A | * | 7/1999 | Georger et al. | 604/367 |
| 6,007,468 | A | * | 12/1999 | Giacometti | 493/341 |
| 6,009,781 | A | * | 1/2000 | McNeil | 83/37 |
| 6,296,601 | B1 | * | 10/2001 | Couturier | 493/365 |

(Continued)

FOREIGN PATENT DOCUMENTS

| | | | |
|---|---|---|---|
| JP | 06-298414 | A | 10/1994 |
| KR | 10-1991-0018294 | A | 11/1991 |
| KR | 10-1993-0011434 | B1 | 12/1993 |
| KR | 10-0163450 | B1 | 12/1998 |

*Primary Examiner* — Christopher Harmon

(74) *Attorney, Agent, or Firm* — Kimberly-Clark Worldwide, Inc.

(57) ABSTRACT

Curvilinear or other complex perforation patterns for paper products, such as paper towels and bath tissue, can be produced using a differential speed perforation nip formed between a rotating pattern roll and a moving anvil surface. The relative speed between the perforation elements on the surface of the pattern roll and the anvil surface shears the web at the perforation points.

17 Claims, 2 Drawing Sheets

(56) References Cited

U.S. PATENT DOCUMENTS

| | | | | |
|---|---|---|---|---|
| 6,420,625 | B1 * | 7/2002 | Jones et al. | 604/367 |
| 6,602,454 | B2 * | 8/2003 | McGuire et al. | 264/167 |
| 6,780,372 | B2 * | 8/2004 | Gray | 264/504 |
| 7,971,526 | B2 * | 7/2011 | Blenke et al. | 101/23 |
| 2007/0240586 | A1 * | 10/2007 | Blenke et al. | 101/23 |
| 2007/0269627 | A1 | 11/2007 | Vinson et al. | |
| 2008/0028902 | A1 | 2/2008 | Baggot et al. | |
| 2008/0280088 | A1 | 11/2008 | Baum | |

* cited by examiner

METHOD FOR PERFORATING TISSUE SHEETS

BACKGROUND OF THE INVENTION

In the manufacture of tissue products, such as bath tissue and paper towels, rolls of tissue webs are provided with transverse lines of perforation to separate the tissue web into individual "sheets" which are detached from the roll by the user by tearing the tissue web along a perforation line. Existing tissue converting equipment imparts perforations to the web by passing the tissue web through a nip between a stationary anvil and a rotating toothed blade. Either the anvil or the blade is skewed in the direction of travel to spread the impact of the blade against the anvil to reduce vibration while maintaining a cutting line perpendicular to the direction of sheet travel. The high speed impact of the blade against the anvil requires hardened steel components with an accurate set up and naturally results in low blade and anvil life and requires frequent maintenance. Also, while it is known that there are advantages to having sheet perforations which are configured differently than the conventional straight perforation lines in order to improve dispensing of the sheets from the roll, a limitation of current perforating systems is that they are substantially limited to providing a single straight line of perforations in the sheet.

It can be seen that what is needed is equipment and a process for making a wide variety of perforation patterns and which is easy to adjust and maintain.

SUMMARY OF THE INVENTION

It has now been discovered that perforations can be imparted to webs, such as tissue webs, via a new low-impact perforation method which provides almost infinite flexibility in terms of the shape or pattern of the perforations imparted to the web of product. The low-impact method of creating perforations in the sheet in accordance with this invention will not only help to increase the reliability of the rewinder compared to existing systems, but also enables new perforation patterns which can improve detachment of the sheets from the roll by the user and also provide visual impact to differentiate rolled products made in accordance with this invention from other rolled products.

Hence in one aspect, the invention resides in a method of perforating a web, such as a tissue sheet, comprising: (a) carrying a moving web over a rotating pattern roll having protruding perforation elements which protrude from the surface of the pattern roll and are arranged on the surface of the pattern roll in a perforation pattern, whereby one side of the web is in contact with and supported by the surface of the pattern roll, said web and the surface of the rotating pattern roll moving at the same speed; and (b) passing the web through nips formed between the protruding perforation elements and a moving anvil surface, such as a rotating anvil roll or a traveling belt, the surface of which is traveling at a speed that is different than the speed of the web, whereby the web is locally sheared and perforated in the nips to create a perforation pattern in the sheet. Contrary to conventional perforation operations, in which the perforations are cut into the web by the shearing action between the perforation blade and the anvil surface with only a single point of contact at any given time (about 0.005 inch), the perforation mechanism of this invention utilizes compression forces spread over a longer sheet/anvil surface contact distance due to the slippage created by the differential speed between the anvil surface and the sheet. More specifically, the contact distances for purposes of this invention can be about 0.01 inch or greater, more specifically from about 0.01 to about 0.5 inch, and still more specifically from about 0.1 to about 0.5 inch. The sheet/anvil surface contact distance and the degree of deflection of the perforation blades/sheet into the resilient anvil surface can be optimized for the particular application in order to prolong the wear of the equipment for the chosen perforation pattern.

Webs useful for purposes of this invention can be cellulosic webs, particularly tissue sheets commonly used for paper towels and bathroom tissue, or the webs can be higher density or higher basis weight paper sheets, non-woven sheets of non-cellulosic fibers, or plastic films. The webs can also be single-ply or multiple-ply webs of the same or different materials.

An advantage of the method of this invention is the fact that it can provide complex perforation patterns while operating at commercial speeds. More specifically, the steady state speed of the web can be about 500 feet/minute (fpm) or greater, more specifically from about 500 to about 3000 fpm, more specifically from about 500 about 2500 fpm, and still more specifically from about 1000 to about 2500 fpm.

In addition, it has been determined that perforation patterns can be used as a subtle visual cue, independent of or in combination with any printed pattern on the product, as a means to improve a user's perception of the product. Since consumers expect that perforations will be in a straight line, any perforation pattern that is different from this can be used to associate other good attributes of the product. An added optional feature of the method of this invention is the ability to mark the perforation pattern with ink to allow the consumer to easily see the perforations. The method of this invention enables unlimited perforation patterns, which not only can be curved lines to improve detachment by the user, but can also include more complex perforations patterns in the form of letters, words, logos, trademarks, objects and the like, all of which can optionally be highlighted with ink.

In the interests of brevity and conciseness, any ranges of values set forth in this specification contemplate all values within the range and are to be construed as written description support for claims reciting any sub-ranges having endpoints which are whole number or otherwise of like numerical values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5. Similarly, a disclosure in this specification of a range from 0.1 to 0.5 shall be considered to support claims to any of the following ranges: 0.1-0.5; 0.1-0.4; 0.1-0.3; 0.1-0.2; 0.2-0.5; 0.2-0.4; 0.2-0.3; 0.3-0.5; 0.3-0.4; and 0.4-0.5. In addition, any values prefaced by the word "about" are to be construed as written description support for the value itself. By way of example, a range of "from about 1 to about 5" is to be interpreted as also disclosing and providing support for a range of "from 1 to 5", "from 1 to about 5" and "from about 1 to 5".

Test Methods

For purposes herein, the coefficient of friction (COF) is the measure of the relative difficulty when the surface of a sheet of tissue is sliding over an adjoining surface of another material, namely the surface of a pattern roll. The test method for measuring the COF determines the kinetic friction of a tissue sheet after it has begun to slide over a given surface. A sled, which has the tissue sheet wrapped around it, is pulled over a platen that has the test surface attached. The test surface and the tissue on the platen are in surface-to-surface contact with each other. The COF represents the average kinetic COF value obtained as the tissue-covered sled travels from 0.5 centimeter (cm) to 4.5 cm away from the beginning point of travel (the first 0.5 cm of travel are is not used in the averaging) at a sled speed of 15 cm per minute.

The following apparatus and material are required: Coefficient of Friction (COF) tester TMI Model 32-90 or equivalent and a 200±5.0 grams Testing Sled with a 63.5 mm×63.5 mm foam test base, both obtained from Testing Machines, Inc., Islanda, N.Y. The tissue specimen for the test sled is prepared by cutting the tissue 120±1 mm in the machine direction (MD) and 67±1 mm in the cross-machine direction (CD). Make a 25.4±10 mm centered cut into one of the 67 mm ends of the tissue to allow the tissue to fit around the guide pin on the test sled. Provide the surface of the test bed or platen with the same surface as the pattern roll.

Conduct the testing in an atmosphere of 23° C.±1° C. and 50%±2% relative humidity. Condition the tissue sample a minimum of 24 hours prior to testing. Calibrate the COF tester according to the manufacturer's directions. In the Setup Procedure section, set the kinetic test speed to 15 cm per minute with a test length of 5 cm. Set the units to COF. Set the portion of the curve to take the average COF on by setting the Default Left CSR to 0.5 cm and the Default Right CSR to 4.5 cm. Name the procedure Kinetic COF.

The tissue sheet is mounted to the test sled, with the side of the sheet in contact with the pattern roll facing up so that side of the tissue sheet will be in surface contact with the test bed material surface, using the clamps on the test sled. The test bed material, which can be a suitable metal sheet, can be mounted on the testing surface the using double-sided adhesive tape. Ensure the surfaces of the test specimens and test bed material are not contaminated during mounting or are wrinkled. Run the test selecting the Kinetic COF procedure in the Run Test mode of the tester, and press the START button.

The results are calculated and displayed by the COF tester. The COF tester records the "KINETIC" value obtained from the average of the values obtained between 0.5 cm and 4.5 cm away from the beginning of the test. The calculation for "KINETIC" coefficient of friction is obtained by the tester using the following equation: $\mu_k = A_s/B$, where $\mu_k$=the kinetic coefficient of friction value, $A_s$=the average gram value obtained over the 4 cm travel, and B=sled weight of 200 grams. A total of five (5) test specimens are tested, as described above, ensuring that a new tissue test specimen is used for each test. The five individual results are averaged and reported for the final result.

DETAILED DESCRIPTION OF THE DRAWINGS

Figure 1:
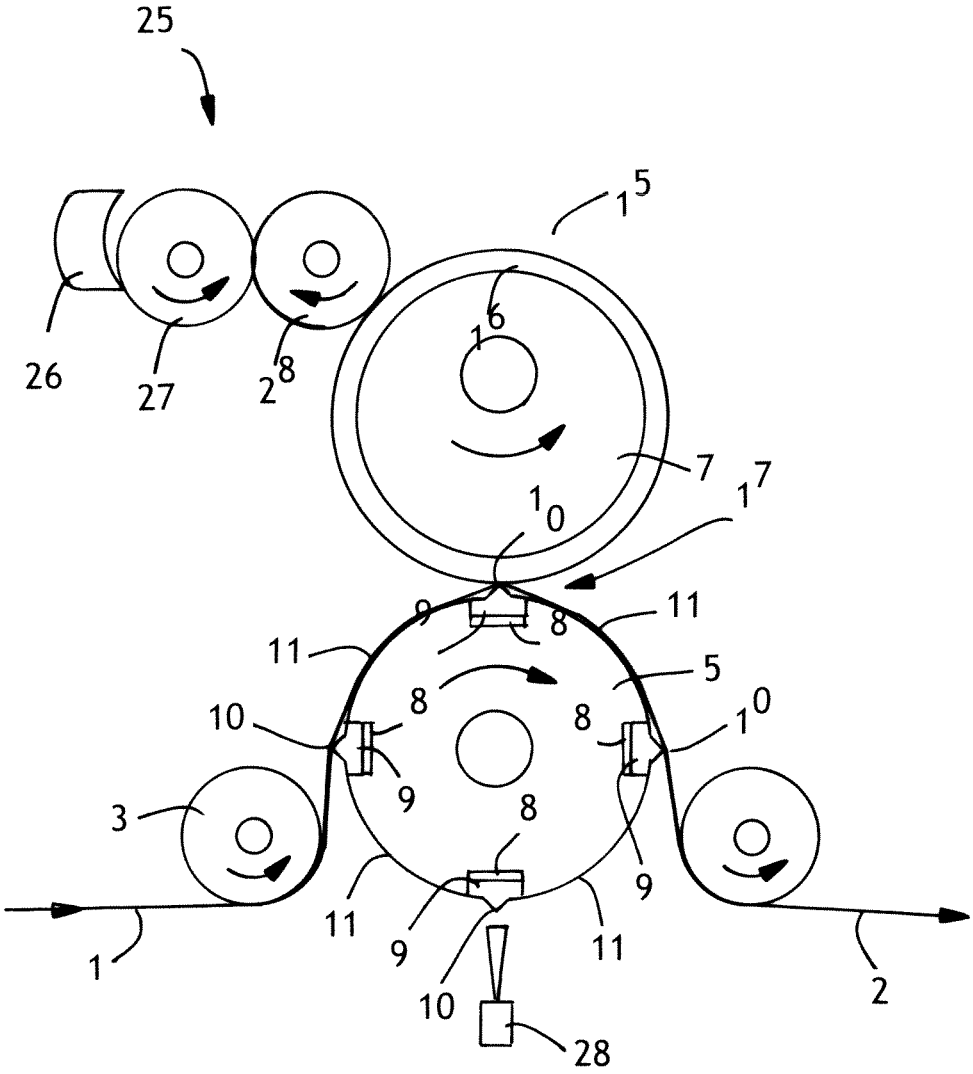
FIG. 1 is a schematic illustration of apparatus and a method of making perforated products in accordance with this invention.

Referring to the drawings, the invention will be described in greater detail. The use of the same reference numbers in different figures is intended to represent the same features.

Directing attention to FIG. 1, shown is an incoming web 1, an outgoing perforated web 2, guide rollers 3 and 4, a rotating pattern roll 5 and a rotating anvil roll 7, both of which are provided with suitable drive means and rotate in the direction of their respective arrows as shown.

The pattern roll contains multiple pattern holding stations 9 (four shown) which contain a pattern of protruding perforation elements 10 which are arranged in the desired perforation pattern and protrude from the surface of the pattern roll. The number of elements can be adjusted to the length between perforating patterns and the diameter of the pattern roll. Advantageously, the pattern holding stations 9 can be replaceable so that the resulting perforation pattern can be changed or the protruding perforation elements can be replaced due to wear. Elements can also be placed at an angle to the axis of the roll to spread out the force of impact of the perforating pattern with the anvil roll. Alternatively, the elements can be placed on a helix pattern around the pattern roll 5 and the angle of the perforation unit adjusted for the correct placement of the pattern in the cross machine direction of the web. The circumferential width of the pattern holding stations depends upon the width of the perforation pattern. Where perforation elements are not present, the surface of the pattern holding station is substantially flush with the surface of the pattern roll with suitable clearance such that the sheet of paper does not contact the rotating anvil roll 7. Optionally, the pattern holding stations 9 can be supported by a resilient material 8, such as rubber, in order to further cushion the impact of the perforation elements against the anvil surface to further improve the wear characteristics of the apparatus. The pattern holding stations can alternatively be supported by liquid- or gas-filled bladders designed to absorb more shock and to further improve the wear characteristics of the apparatus.

The surface 11 of the pattern roll between the various pattern holding stations preferably is provided with a high coefficient of friction relative to the web, such as by coating the surface with a wide variety of materials, such as tungsten carbide, using a plasma or flame spray coating process. Suitable coating processes and coating manufacturers are well known in the art. The surface of the pattern roll can also be textured by etching, grit blasting or machining in order to increase the coefficient of friction. A high coefficient of friction between the pattern roll surface and the web ensures that the pattern roll surface speed is the same or substantially the same as the web speed. The high coefficient of friction between the web and the surface of the pattern roll, advantageously in combination with a high angle of wrap around the pattern roll created by the location of the guide rollers 3 and 4, prevents slippage of the web during the shearing motion when the perforations are cut into the web. In this regard, the amount of wrap by the web around the pattern roll can be about 180 degrees or greater, more specifically from about 180 to about 330 degrees, and still more specifically from about 270 to about 300 degrees.

The kinetic coefficient of friction (COF) between the surface of the pattern roll and the web can be about 0.3 or greater, more specifically from about 0.3 to about 1.5, and still more specifically from about 0.5 to about 0.7.

While the anvil roll 7 can be a conventional solid metal roll, particularly if the pattern holding stations 9 are provided with a shock-absorbing backing or supporting material, the anvil roll can advantageously comprise a hardened steel ring surface 15 supported by a resilient backing 16, such as soft rubber or an inflatable bladder, in order to serve as a shock absorber and reduce wear. A benefit of having a shock absorbing anvil roll surface is to reduce the precision or accuracy required when setting up the apparatus and reducing the rate of wear of the pattern elements.

If a rubber material is chosen as the resilient backing material for the pattern elements and/or the anvil roll, a relatively soft rubber can be used. More particularly, the Shore A hardness of the rubber can be about 70 or less, more specifically from about 70 to about 30, and still more specifically from about 60 to about 40.

In operation, the surface of the anvil roll is traveling at a different speed than the surface of the pattern roll, such that when the web passes through a nip 17 formed between a protruding perforation element and the surface of the anvil roll, the web is locally sheared to create perforations in the web that correspond to the desired perforation pattern. The surface of the anvil roll can be travelling at a speed which is slower or faster than the speed of the web. More specifically, the surface speed of the anvil roll can be from about 1 to 20 percent faster than the speed of the web, more specifically from about 5 to about 20 percent faster, more specifically from about 10 to about 20 percent faster, and still more specifically from about 10 to about 15 percent faster. Alternatively, the surface speed of the anvil roll can be from about 1 to 20 percent slower than the speed of the web, more specifically from about 5 to about 20 percent slower, more specifically from about 10 to about 20 percent slower, and still more specifically from about 10 to about 15 percent slower.

Also shown in FIG. 1 is an optional printing station or marking unit 25 which can be used to print ink or other chemicals, such as debonder, onto the web in the perforated areas. Ink can be used to enhance the visibility or appearance of the perforations. Debonder can be used to further weaken the portion of the web between the perforation cuts. Chemicals can be applied such that they have limited effect on the perforations when applied, but weaken the perforations over time, such as after the product is packaged. Shown is a chamber doctor 26, an anilox roll 27 and a transfer roll 28. If ink is used, the ink can optionally contain a lubricant to reduce wear between the anvil roll 7 and the pattern elements 9. In addition, an optional lubricant application device 28, which can be a sprayer or roller, can be positioned below the pattern roll 5 and serve to lubricate the perforation elements to reduce wear. A particularly suitable lubricant is white mineral oil. The use of a roller is particularly advantageous because it would only apply the lubricant to the tips of the perforating elements and thereby maintain the high coefficient of friction between the shell or surface of the pattern roll and the web.

Figure 2:
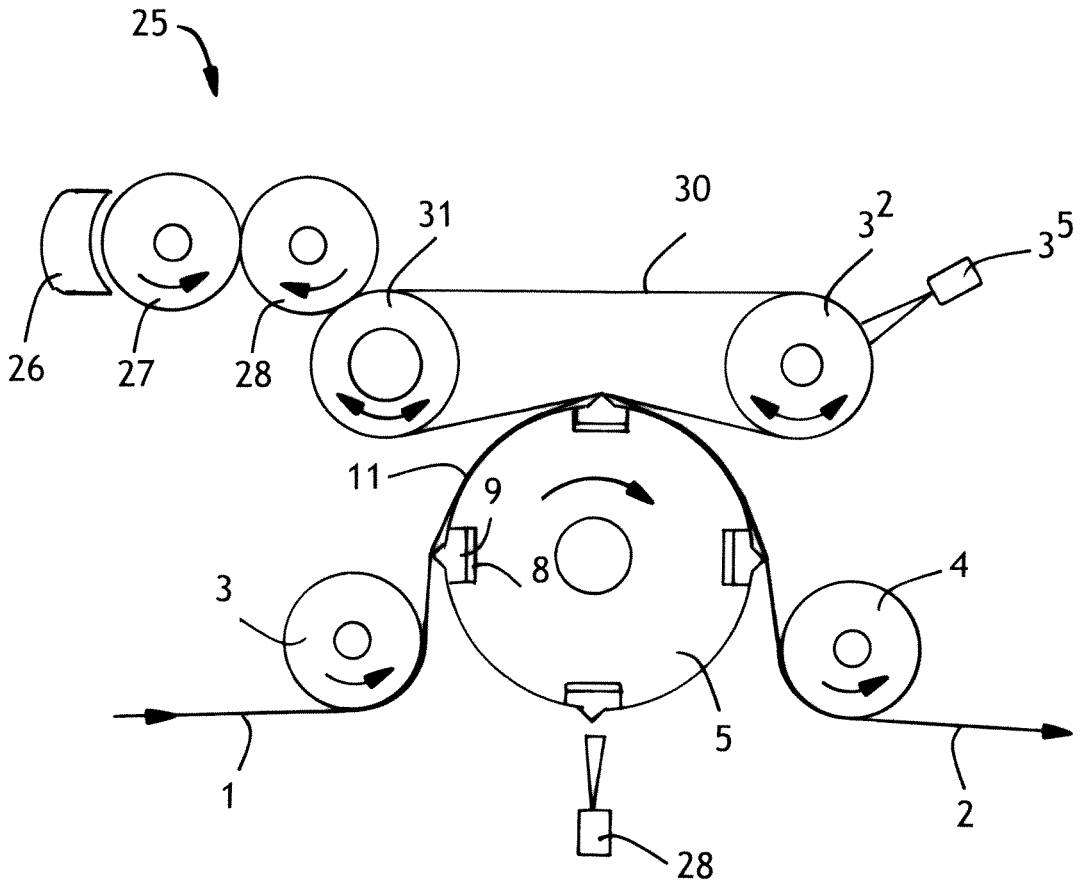
FIG. 2 is a schematic illustration of another embodiment of apparatus and a method of making perforated products in accordance with this invention.

FIG. 2 shows an alternative embodiment of the invention in which the anvil roll is replaced with an anvil belt 30 passing around rolls 31 and 32. Roll 31 is suitably the drive roll. As with the embodiment of FIG. 1, a speed differential between the anvil belt surface and the web creates shear forces that impart perforations in the web. The speed differentials recited above for the anvil roll embodiment also apply to this embodiment. Suitable anvil belts can be made from any highly wear-resistant material, such as polyurethane or nylon. While belts have not been previously been made for this purpose, belts suitable for purposes herein can be made by commercial belt manufacturers, such as Albany International, for example. It is advantageous to make the anvil belts in a layered manner where the surface of the belt in contact with the web supported by the perforation elements has high wear resistance, while the backing material is optimized for high strength.

In operation, the anvil belt is positioned under tension and urged against the pattern roll with sufficient pressure to deflect the belt and create the perforations in the web. An advantage of this embodiment, compared to that of FIG. 1, is that the set-up or positioning of the anvil belt relative to the pattern roll is relatively easy to accomplish. Also, the dwell time or extended contact distance between the web and the anvil surface is greatly increased, thereby allowing a lower pressure between the anvil surface and the pattern roll to be used. As shown, a cleaning brush or spray device 35 can be provided to maintain the surface of the belt clean by removing dust and debris that may collect during the perforation step.

It will be appreciated that the foregoing description and drawings, given for purposes of illustration, are not to be construed as limiting the scope of this invention, which is defined by the following claims and all equivalents thereto.

We claim:

1. A method of perforating a paper web comprising:

(a) carrying a moving paper web over a rotating pattern roll having protruding perforation elements which protrude from the surface of the pattern roll and are arranged on the surface of the pattern roll in a perforation pattern, whereby one side of the paper web is in contact with and supported by the surface of the pattern roll and wherein the angle of wrap of the paper web around the pattern roll is about 180 degrees or greater, said paper web and the surface of the rotating pattern roll moving at the same speed; and (b) passing the paper web through nips formed between the protruding perforation elements and a moving anvil surface which is traveling at a speed that is faster than the speed of the paper web, whereby the paper web is locally sheared and perforated in the nips to create a perforation pattern in the web.

2. The method of claim 1 wherein the anvil surface is traveling from about 1 to about 20 percent faster than the speed of the paper web.

3. The method of claim 1 wherein the anvil surface is traveling from about 5 to about 20 percent faster than the speed of the paper web.

4. The method of claim 1 wherein the anvil surface is traveling from about 10 to about 20 percent faster than the speed of the paper web.

5. The method of claim 1 wherein the anvil surface is traveling from about 10 to about 15 percent faster than the speed of the paper web.

6. The method of claim 1 wherein the anvil surface is a moving belt.

7. The method of claim 1 wherein the anvil surface is a rotating anvil roll.

8. The method of claim 7 wherein the anvil roll has a hardened steel surface supported by a resilient material.

9. The method of claim 8 wherein the resilient material is rubber.

10. The method of claim 1 wherein the perforation elements are supported by resilient material.

11. The method of claim 10 wherein the resilient material is rubber.

12. The method of claim 10 wherein the resilient material is an inflatable bladder.

13. The method of claim 1 wherein the coefficient of friction between the surface of the pattern roll and the paper web is of about 0.3 or greater.

14. The method of claim 1 wherein the coefficient of friction between the surface of the pattern roll and the paper web is from about 0.3 to about 1.5.

15. The method of claim 1 wherein the angle of wrap of the paper web around the pattern roll is from about 180 to about 330 degrees.

16. The method of claim 1 wherein ink is printed onto the paper web along the perforation pattern.

17. The method of claim 1 wherein debonder is printed onto the paper web along the perforation pattern.

* * * * *